US008534722B2

(12) United States Patent
Schmid et al.

(10) Patent No.: US 8,534,722 B2
(45) Date of Patent: Sep. 17, 2013

(54) SAFETY INTERLOCKING DEVICE WITH ESCAPE UNLOCKING MEANS

(75) Inventors: Max Schmid, Wangs (CH); Fouad Mahdi, Bondaduz (CH)

(73) Assignee: Pilz Auslandsbeteiligungen GmbH, Ostfildern (DE)

( * ) Notice: Subject to any disclaimer, the term of this patent is extended or adjusted under 35 U.S.C. 154(b) by 813 days.

(21) Appl. No.: 12/481,679

(22) Filed: Jun. 10, 2009

(65) Prior Publication Data

US 2009/0302617 A1 Dec. 10, 2009

(30) Foreign Application Priority Data

Jun. 10, 2008 (CH) ..... 881/08

(51) Int. Cl.
*E05B 15/02* (2006.01)
*E05B 65/10* (2006.01)

(52) U.S. Cl.
USPC ..... 292/341.17; 292/92; 292/DIG. 65; 292/DIG. 37

(58) Field of Classification Search
USPC ..... 292/346, 92–94, 340, 207, 237, 341.15, 292/341.17, 342, DIG. 24, DIG. 37, DIG. 41, 292/DIG. 65, DIG. 71; 70/92, 465; 49/50, 49/56, 57, 141, 394
See application file for complete search history.

(56) References Cited

U.S. PATENT DOCUMENTS

| | | | | |
|---|---|---|---|---|
| 2,747,906 | A * | 5/1956 | Emmert | 292/92 |
| 2,762,645 | A * | 9/1956 | Bordner, Jr. | 292/341.17 |
| 2,772,110 | A * | 11/1956 | Petrochko | 292/341.17 |
| 3,936,086 | A * | 2/1976 | Berkowitz | 292/341.17 |
| 4,547,008 | A * | 10/1985 | Takasaki | 292/341.15 |
| 4,765,662 | A * | 8/1988 | Suska | 292/92 |

* cited by examiner

*Primary Examiner* — Carlos Lugo
*Assistant Examiner* — Alyson M Merlino
(74) *Attorney, Agent, or Firm* — Bachman & LaPointe, P.C.

(57) ABSTRACT

A safety interlocking device has a locking unit for mounting on the safe side to a door relative to a hazardous region, and a locking cage for mounting on a door frame interacting with the door. In order to be able to open, from the hazardous region, the locked door and escape from the hazardous region, an escape unlocking device is provided for unlocking the safety interlocking device. The locking cage has a locking stop which is articulated to a base plate so as to be able to pivot about a pivot axis from an interlocking position into an emergency opening position. The escape unlocking device possesses at least one arresting tip which, in an escape position, releases the locking stop for pivoting into the emergency opening position. Provided between an emergency handle and the arresting tip is a stretched rod piece which is embodied so as to be displaceable together with the arresting tip. In the normal position of the escape unlocking (EU) device, the arresting tip is in arresting operative connection with a first arresting surface of the locking stop and a second arresting surface of the base plate. At least one of these operative connections can be released by displacement of the arresting tip in the rod direction.

7 Claims, 4 Drawing Sheets

SAFETY INTERLOCKING DEVICE WITH ESCAPE UNLOCKING MEANS

BACKGROUND

The invention relates to a safety interlocking device (referred to hereinafter as the SI device) with an escape unlocking means (referred to hereinafter as the EU means). Entrances to hazardous spaces have to be protected using SI devices. These devices ensure that the entrance is cleared only when specific conditions are met, so that the hazardous space may be entered safely. An SI device requires an EU means, as it must be possible to leave the hazardous space at all times, i.e. including when the entrance is closed. The escape unlocking of the SI device may therefore be possible merely from the hazardous space. The safety of the SI device is ensured by mechanisms for monitoring the interlocking state of a lock.

SUMMARY OF THE INVENTION

The object of the invention is to propose a safety interlocking device with an economical escape unlocking means.

According to the invention, this object is achieved by the safety interlocking device set forth in the claims.

A safety interlocking device of this type comprises:

a) A locking unit for mounting on the safe side to a door relative to a hazardous region. This locking unit comprises a guide which can be fastened to the door and a lock which is guided in the guide and has an actuating handle.

b) A locking cage for mounting on a door frame interacting with the door.

c) An escape unlocking (EU) means for unlocking the safety interlocking device. This escape unlocking means allows the safety interlocking device to be unlocked from the hazardous region. This serves to open the locked door from the hazardous region, in order to be able to escape from the hazardous region.

According to the invention, an economical and safe solution for an escape unlocking means is attained by the following features.

A device according to the invention is distinguished by the following features:

The locking cage comprises a base plate which can be fastened to the door frame and has a bearing surface for bearing against the door frame, and a locking stop which is articulated to the base plate so as to be able to pivot about an axis from an interlocking position into an emergency opening position, and also the escape unlocking means.

The escape unlocking means has an emergency handle and at least one arresting tip. It can assume a normal position, in which it arrests the pivotability of the locking stop in the interlocking position, and an escape position, in which it releases the locking stop for pivoting into the emergency opening position.

A stretched rod piece is provided between the emergency handle and the arresting tip. This stretched rod piece and the arresting tip are embodied so as to be displaceable perpendicularly to the bearing surface on the base plate of the locking cage. In the normal position of the EU means, the arresting tip is in arresting operative connection with a first arresting surface of the locking stop and a second arresting surface of the base plate. The arresting tip as a result non-rotatably connects the locking stop to the base plate.

At least one of these operative connections can be released by displacement of the arresting tip in the rod direction.

Taken together, these features ensure simple operation and a simple construction of the EU means. The displacement of the arresting tip arresting the locking stop can be attained directly by displacement of the rod. At the same time, it is not possible to unlock the locking stop from the safe side, without deliberately making major changes to and interventions in the SI device. The interlocking of the locking stop can resist high forces, but can be released from the hazardous space by merely low forces.

In the normal position, these arresting surfaces and the axis of the locking stop are expediently positioned relative to one another in such a way that rotation of the locking stop into the emergency opening position requires pivoting of the first arresting surface into a region which the arresting tip assumes in the normal position. This arrangement of the interacting parts causes direct blocking of this movement, provided that the arresting tip is in the normal position. Movement of the locking stop means that the arresting tip is either out of operative connection with the locking stop or can be pivoted together with the locking stop. If, however, the arresting tip is in operative connection with the first and the second arresting surface, neither of the two conditions is met and the locking stop is non-rotatably connected to the base plate.

In a preferred embodiment, the arresting tip engages, at least in the normal position, with a hole in the locking stop. A hole in the locking stop and a round rod which interacts therewith and is inserted therein, as the arresting tip, reliably interlock rotation of the locking stop about its axis positioned perpendicularly to the axial direction of the hole. As the rod and the arresting tip are concealed within the SI device and the door frame and the emergency handle is visible and operable merely from the hazardous side, the arresting of the locking stop cannot be handled from the safe side.

However, the arresting tip does not need to engage with the locking stop. It can also fill out an intermediate space between an outer surface of the locking stop and an inner surface of the base plate. In this case, the intermediate space would have to be reduced, at least in a partial region, on rotation of the locking stop about its pivot axis; this is prevented by an arresting tip provided there. If, however, the arresting tip is removed from this region, the locking stop can pivot freely.

There can be articulated to the base plate two locking stops which can pivot in opposite directions of rotation from the interlocking position into the emergency opening position. In this case, the EU means has for each locking stop an arresting tip and a rod, which rods expediently possess a common emergency handle. The emergency handle therefore allows both rods to be displaced at the same time and therefore both locking stops to be unlocked at the same time.

In principle, it is possible to unlock the locking stop by pressing the emergency handle or by pulling the emergency handle. These two possibilities require different solutions in the arresting tip and rod. If the arresting tip forms the tip of the rod, then it is preferable for said tip to be able to be brought out of operative connection with the first arresting surface of the locking stop by pulling the emergency handle. Pulling the emergency handle causes the rod and the arresting tip to be jointly displaced from the safe side toward the hazardous side and thus the arresting tip to be moved out of the pivot region of the first arresting surface. In this embodiment of the arresting tip on the rod, unlocking can also be attained by pressing the emergency handle. This requires the arresting tip to fill out the above-mentioned intermediate space between the outer surface of the locking stop and the inner surface of the base plate and to have on the hazardous space side of its arresting region a less voluminous region allowing pivoting of the locking stop.

Unlocking by pressing the emergency handle is attained also by the following embodiment: The arresting tip is a part which is independent of the rod. It can be brought out of operative connection with the second arresting surface on the base plate by pressing the emergency handle and jointly displacing the rod and arresting tip. That is to say, the arresting tip then passes out of a guide region in the base plate, thus allowing it to pivot together with the locking stop.

BRIEF DESCRIPTION OF THE DRAWINGS

The invention will be described hereinafter in greater detail with reference to the figures, in which.

DETAILED DESCRIPTION OF THE PREFERRED EMBODIMENT(S)

Figure 1A:
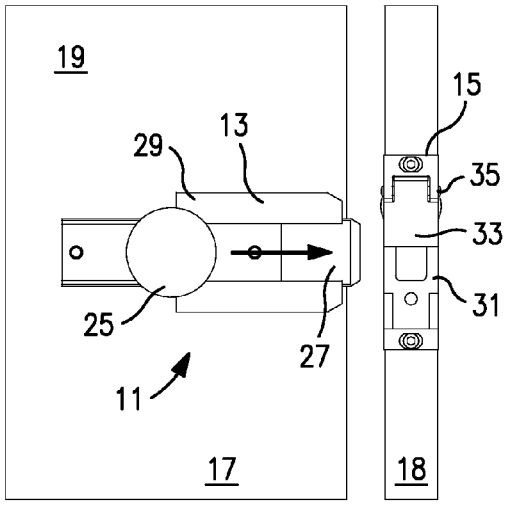
FIGS. 1A and 1B are a view of an SI device mounted on the door and door frame in an open position and in the closed position.
Figure 1B:
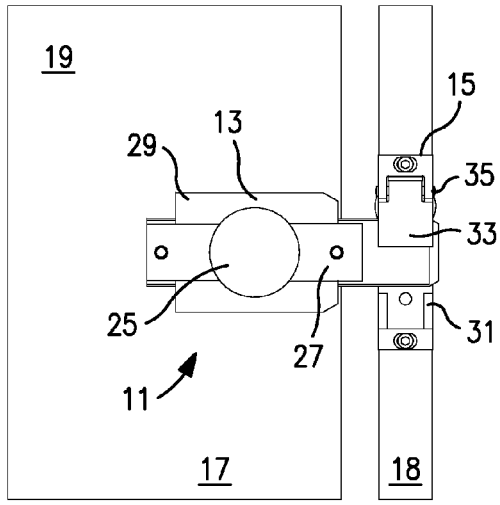
Figure 2A:
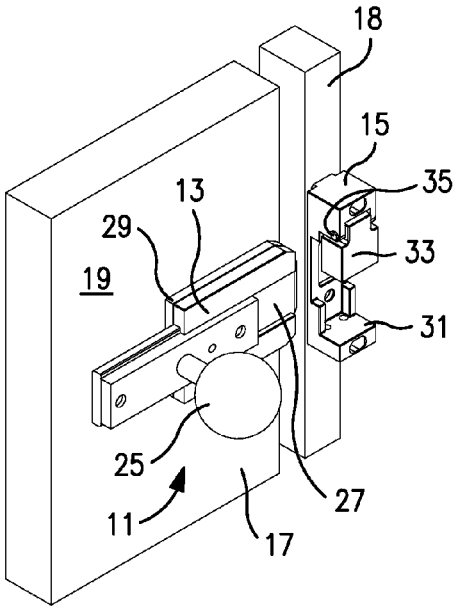
FIGS. 2A and 2B are a perspective view of the same mounted SI device in the positions shown in FIGS. 1A and 1B.
Figure 2B:
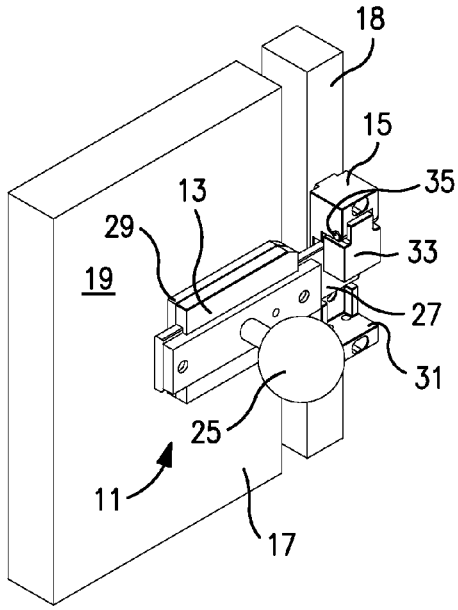
Figure 3:
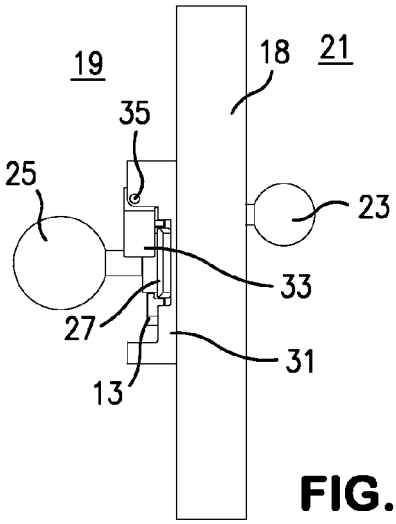
FIG. 3 is a section through the door frame looking onto the SI device.
Figure 4:
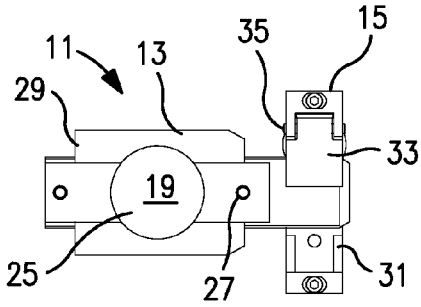
FIG. 4 is a view of the SI device without the door and door frame.
Figure 5A:
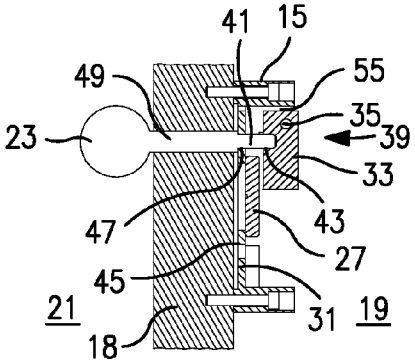
FIGS. 5A-5D show four sections through the EU means. Each of the four drawings represents a different position of the unlocking means or the locking stop.
Figure 5B:
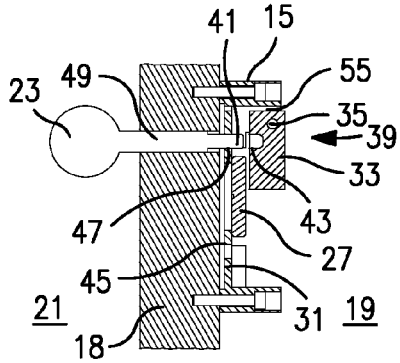
Figure 5C:
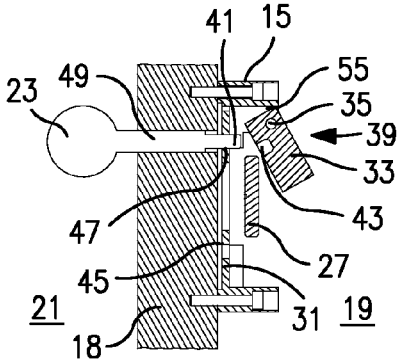
Figure 5D:
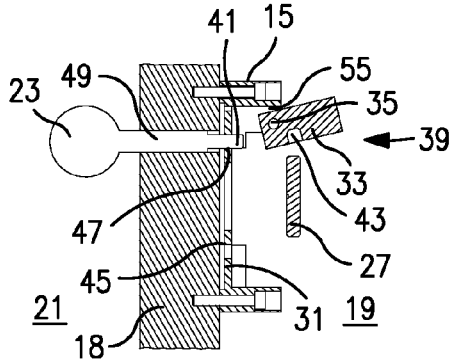
Figure 6:
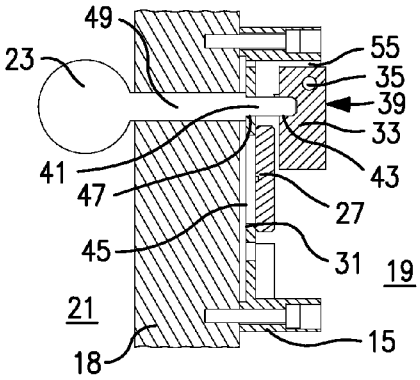
FIGS. 6 and 7 are sections through the EU means. In each drawing, the position of the arresting surface on the locking stop is selected differently.
Figure 7:
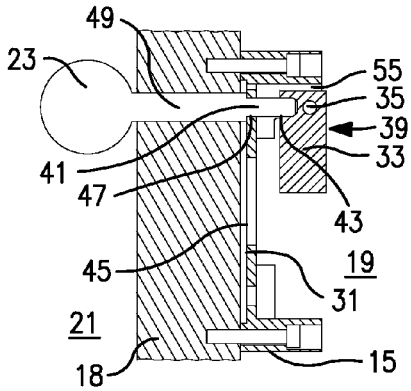
Figure 8A:
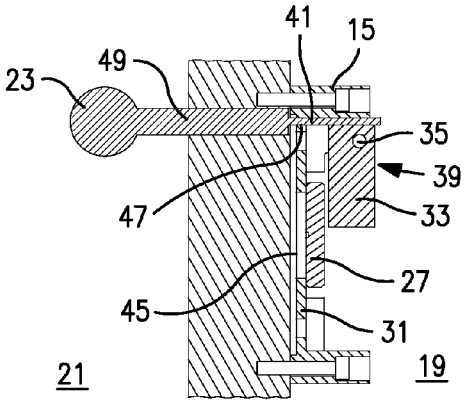
FIGS. 8A and 8*b* and FIGS. 9A and 9B show four sections through an EU means filling an intermediate space between the locking stop and base plate. Each of the four drawings represents a different position of the unlocking means or the locking stop.
Figure 8B:
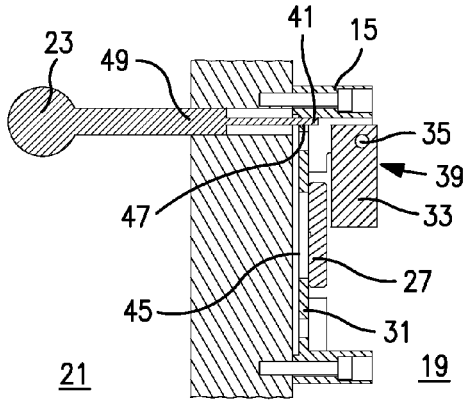
Figure 9A:
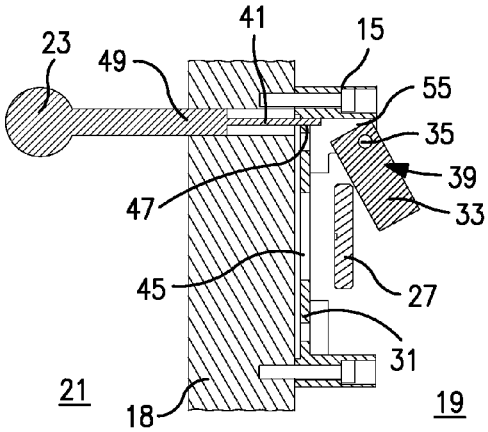
Figure 9B:
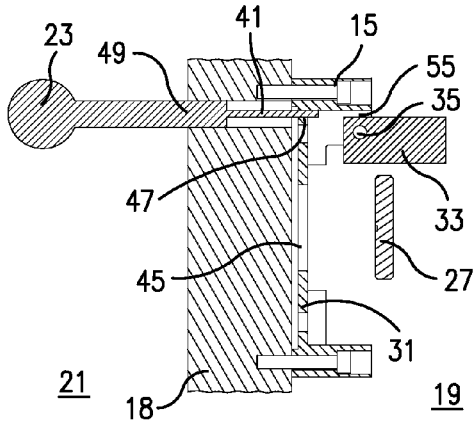
Figure 10:
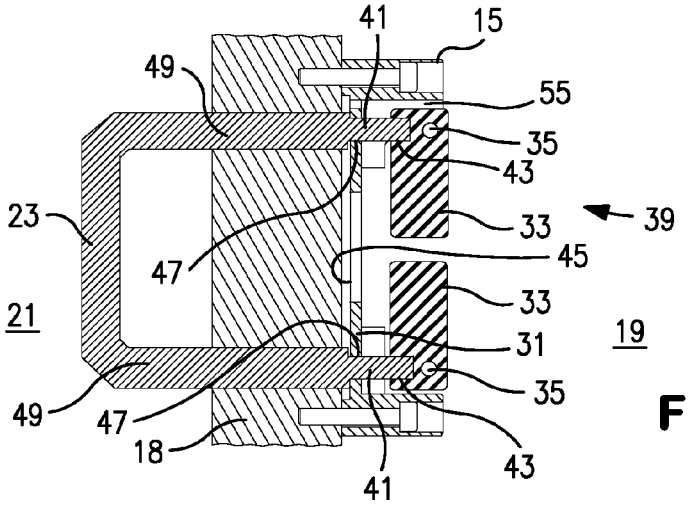
FIG. 10 is a section through an embodiment embodied with two locking stops.
Figure 11:
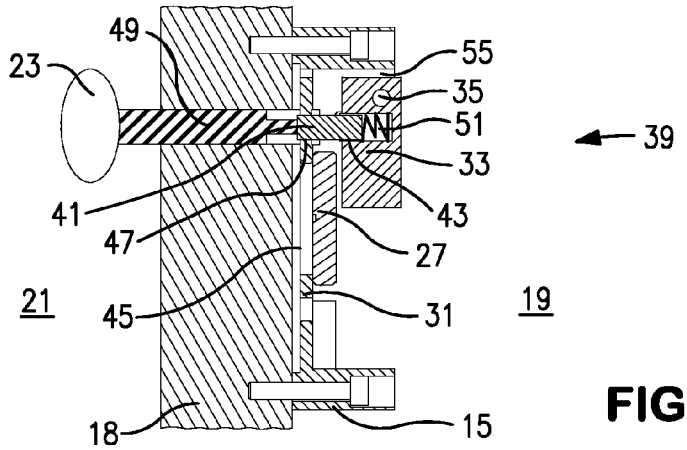
FIG. 11 is a section through an embodiment in which the unlocking is carried out by pressing the emergency handle.

The first embodiment illustrated in FIGS. 1 to 6 and the second embodiment illustrated in FIG. 7, like the third illustrated in FIGS. 8 and 9, the fourth illustrated in FIG. 10 and the fifth embodiment illustrated in FIG. 11 of SI devices 11 possess a locking unit 13 and a locking cage 15.

The locking unit 13 is fastened to a door 17 to a hazardous space: to the safe side 19 of this door. There are embodied on the hazardous space side 21 of this door 17 an emergency handle 23, on the safe side 19 an actuating handle 25 for the lock 27. The lock 27 is displaceably guided in a locking guide 29. The locking guide 29 is screwed to the door 17.

The locking cage 15 is arranged on the door frame 18. It possesses a base plate 31 and a locking stop 33 articulated thereto. The locking stop 33 can pivot about the pivot axis 35, provided that this pivoting is released by actuating the escape unlocking means. The lock 27 reaches, in the closed position of the SI device, between the base plate 31 and locking stop 33. The locking stop 33 is arrested by the escape unlocking means in its normal position, i.e. so as to be unable to pivot relative to the base plate 31. The door 17 is therefore interlocked.

The interlocking is generally monitored by electronic means and/or electromechanical means and/or magnetic means. This involves monitoring the position of the lock relative to the locking stop. In addition, the arresting of the locking stop is generally monitored. The monitoring means do not form the subject-matter of the present invention, although SI devices according to the invention are generally speaking equipped with such means.

Essential to the invention is the simple manner in which the locking stop is arrested. This can take place in a slightly different manner without departing from the inventive concept:

In the first exemplary embodiment illustrated in FIGS. 1 to 6, the second exemplary embodiment illustrated in FIG. 7 and the fourth and fifth exemplary embodiments illustrated in FIGS. 10 and 11, in the normal position an arresting tip 41 is positioned at all times in a hole 43 in the locking stop 33. The hole 43 is formed perpendicularly to the bearing surface 45 of the base plate. Axially to the first hole 43 in the locking stop 33, a second hole 47 is also formed in the base plate 31. The arresting tip 41 extends through both holes 43, 47. Because the first arresting surfaces in the first hole and the second arresting surfaces in the second hole are not arranged coaxially with the pivot axis 35, they have to pass through a relative change in angle in relation to one another during pivoting of the locking stop. However, this change in angle is prevented by the rigid arresting tip 41. Said arresting tip is in abutment with the two abutment surfaces and therefore does not permit pivoting. However, displacement of the arresting tip along its axis extending perpendicularly to the bearing surface of the base plate allows it to be brought out of operative connection with one of these arresting surfaces.

In this respect, exemplary embodiments 1, 2 and 4 differ from exemplary embodiment five according to FIG. 11. In the first exemplary embodiments, the arresting tip is part of a rod 49 on which the emergency handle 23 is embodied. By pulling the emergency handle, the rod 49 and the arresting tip 41 are jointly pulled out of the engagement with the first hole in the locking stop. However, in the exemplary embodiment according to FIG. 11, the rod 49 and the arresting tip 41 form two mutually independent parts. However, in the normal position, they are arranged coaxially and embodied so as to be jointly displaceable. If the emergency handle 23 is pulled, then the distance between the arresting tip 41 and the tip of the rod increases. The arresting tip 41 remains in this case without alteration in operative connection both with the arresting surface in the base plate 31 (second hole) and with the arresting surface in the locking stop (first hole). Such movement of the emergency handle 23 and the rod 49 can therefore be prevented. If on the other hand, the emergency handle 23 is pressed, then the tip of the rod brings the arresting tip 41 out of engagement with the base plate. The pressure acting on the arresting tip 41 is transmitted to the locking stop 33 via the spring 51, so that said locking stop springs open. By pressing on the door and the lock, the locking stop can then be pivoted through 90 degrees and the door then pushed open.

Figure 12:
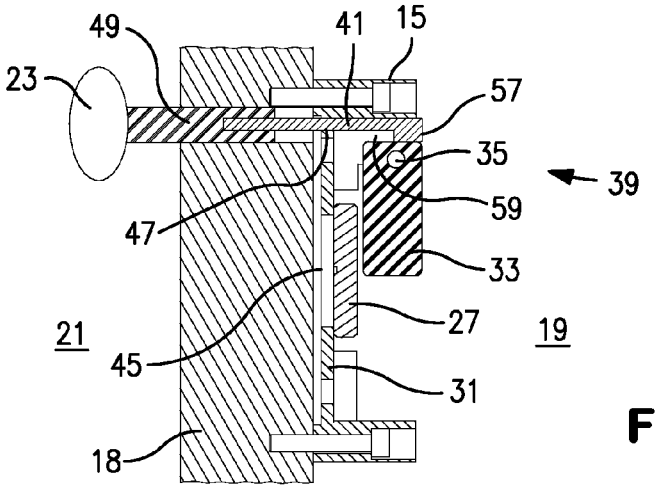
FIG. 12 is a section through a sixth embodiment in which the unlocking is carried out by pressing the emergency handle.

Still another escape unlocking is realised in the exemplary embodiments according to FIGS. 8-9 and 12. In these third and sixth exemplary embodiments, the interlocking tip 41 does not engage with the locking stop 33. Formed between the locking stop 33 and a fastening flange 53 on the base plate 31 is an intermediate space 55 which is filled out by a plate-shaped arresting tip 41. During pivoting of the locking stop, parts of the locking stop 33 are pivoted into the region of this intermediate space 55. This is prevented by the arresting tip 41 which is arranged there. Forces which seek to pivot the locking stop 33 are conducted via the outer surface of the locking stop 33 onto the arresting tip 41 and therefrom onto the fastening flange 53. Thus, in this embodiment too, the arresting tip 41 ensures that the locking stop 33 is non-rotatably arrested relative to the base plate 31.

By pulling the emergency handle 23 of the exemplary embodiment according to FIGS. 8 and 9, the rod 49, and thus the arresting tip 41, is displaced in the direction toward the hazardous space. As a result, the leading end of the arresting tip 41 passes after an escape perpendicularly to the direction of displacement of the arresting tip and through the pivot axis 35 of the locking stop 33. From this moment, the intermediate space, which is necessary for the pivoting of the locking stop 33, between the locking stop and the base plate is free and the locking stop can pivot.

However, in the exemplary embodiment according to FIG. 12, the EU means 39 is designed for pressure acting on the emergency handle 23 for unlocking the locking stop 33. The arresting tip 41 is thickened right at the front, so that after this thickening 57 there is an intermediate space 59 between the arresting tip 41 and the outer surface of the locking stop 33. By pressing the emergency handle 23, this thickening is pushed toward the safe side beyond the stop region on the locking stop 33. The locking stop can now be pivoted, as the intermediate space 59 cannot put up any resistance to the parts of the locking stop that pivot toward the arresting tip. In this design, it is also possible to pull the emergency handle 23 in order to unlock the locking stop. A design of this type therefore provides an SI device, the EU means of which is unlocked both by pulling and by pressing the emergency handle. One of both possibilities can also be purposefully prevented by configuring a corresponding stop to prevent a pulling movement or a stop to prevent a pushing movement. A stop of this type can be provided to prevent handling from the safe side.

In summary, the invention may be regarded as a safety interlocking device (11) comprising a locking unit (13) for mounting on the safe side (19) to a door (17) relative to a hazardous region, and a locking cage (15) for mounting on a door frame (18) interacting with the door (17). In order to be able to open, from the hazardous region, the locked door (17) and escape from the hazardous region, an escape unlocking means (39) is provided for unlocking the safety interlocking device (11). The locking cage (15) has a locking stop which is articulated to a base plate (31) so as to be able to pivot about a pivot axis (35) from an interlocking position into an emergency opening position. The escape unlocking means (39) possesses at least one arresting tip (41) which, in an escape position, releases the locking stop (33) for pivoting into the emergency opening position. Provided between an emergency handle (23) and the arresting tip (41) is a stretched rod piece (49) which is embodied so as to be displaceable together with the arresting tip (41). In the normal position of the EU means (39), the arresting tip (41) is in arresting operative connection with a first arresting surface of the locking stop (33) and a second arresting surface of the base plate (31). At least one of these operative connections can be released by displacement of the arresting tip (41) in the rod direction.

The invention claimed is:

1. A safety interlocking device, comprising:

a) a locking unit for mounting on a safe side of a door relative to a hazardous region having a door frame to which the door is mounted for opening and closing, the locking unit comprises a guide which can be fastened to the door and a lock bolt which is guided in the guide and has an actuating handle, said lock bolt being movable in a movement direction between a first unlocked position in which the door is unlocked and a second locked position in which the door is locked, b) a locking cage for mounting on the door frame interacting with the door, c) an escape unlocking means accessible from the hazardous region and configured to allow a user to open, from the hazardous region, the door when locked by the lock bolt and escape from the hazardous region, d) the locking cage comprising a base plate which can be fastened to the door frame and having a bearing surface for bearing against the door frame, and at least one locking stop which is articulated to the base plate so as to be able to pivot about a pivot axis from an interlocking position into an emergency opening position, wherein the pivot axis is oriented parallel to the movement direction of the lock bolt and when the at least one locking stop is in the interlocking position and the lock bolt is in the second locked position, the lock bolt is received between the at least one locking stop and the base plate, e) the escape unlocking means comprising an emergency handle and at least one arresting tip, and movable between a normal position, in which the at least one arresting tip arrests the pivotability of the at least one locking stop in the interlocking position, and an escape position, in which the at least one locking stop is released for pivoting into the emergency opening position, allowing the user to open the door from the hazardous region, f) at least one rod connecting the emergency handle to the at least one arresting tip, in which the at least one rod and the at least one arresting tip are embodied so as to be displaceable perpendicularly to the bearing surface on the base plate of the locking cage when the escape unlocking means is moved between the normal position and the escape position, such that when the escape unlocking means is in the normal position, the at least one arresting tip is in arresting operative connection with a first arresting surface of the at least one locking stop and a second arresting surface of the base plate, and g) the arresting operative connection being released by displacement of the at least one arresting tip perpendicularly to the bearing surface on the base plate.

2. The safety interlocking device according to claim 1, wherein the arresting surfaces and the pivot axis of the at least one locking stop are positioned relative to one another in such a way that rotation of the at least one locking stop from the interlocking position into the emergency opening position requires pivoting of the first arresting surface into a region which the at least one arresting tip assumes in the normal position.

3. The safety interlocking device according to claim 1, wherein the at least one arresting tip engages with a hole having the first arresting surface in the at least one locking stop.

4. The safety interlocking device according to claim 1, wherein the at least one arresting tip fills out an intermediate space between the first arresting surface and the second arresting surface, the first arresting surface being an outer surface of the at least one locking stop and the second arresting surface being an inner surface of the base plate.

5. The safety interlocking device according to claim 1, wherein the at least one locking stop comprises two locking stops that are articulated to the base plate so as to pivot in opposite directions of rotation from the interlocking position into the emergency opening position, and wherein the at least one arresting tip comprises two arresting tips, and the at least one rod comprises two rods.

6. The safety interlocking device according to claim 1, wherein the at least one arresting tip forms the tip of the at least one rod, and can be brought out of operative connection with the first arresting surface of the at least one locking stop by pulling the emergency handle and jointly displacing the at least one rod and the at least one arresting tip and thus moving the at least one arresting tip out of operative connection with the first arresting surface.

7. The safety interlocking device according to claim 1, wherein the at least one arresting tip is independent of the at least one rod, and can be brought out of operative connection with the second arresting surface on the base plate by pressing the emergency handle and jointly displacing the at least one rod and the at least one arresting tip and thus moving the at least one arresting tip out of a guide region having the second arresting surface.

* * * * *